US008001632B2

(12) United States Patent
Sanders et al.

(10) Patent No.: US 8,001,632 B2
(45) Date of Patent: Aug. 23, 2011

(54) FOLDING FOOT PROTECTION DEVICE FOR A BEDDED PATIENT

(75) Inventors: Beverly Sanders, Shiner, TX (US); Don Kaspar, Shiner, TX (US)

(73) Assignee: Beverly Sanders, Shiner, TX (US)

( * ) Notice: Subject to any disclaimer, the term of this patent is extended or adjusted under 35 U.S.C. 154(b) by 0 days.

(21) Appl. No.: 12/814,542

(22) Filed: Jun. 14, 2010

(65) Prior Publication Data

US 2010/0319127 A1 Dec. 23, 2010

Related U.S. Application Data

(60) Provisional application No. 61/218,664, filed on Jun. 19, 2009.

(51) Int. Cl.
*A47C 21/02* (2006.01)

(52) U.S. Cl. ..... 5/505.1

(58) Field of Classification Search ..... 5/504.1, 5/505.1; 108/49; 211/85.31, 181.1
See application file for complete search history.

(56) References Cited

U.S. PATENT DOCUMENTS

| | | | | |
|---|---|---|---|---|
| 1,072,490 | A | 9/1913 | Oilar | |
| 1,186,032 | A | 6/1916 | Peele | |
| 1,835,798 | A * | 12/1931 | McKay | 5/505.1 |
| 2,106,834 | A | 2/1938 | Ewald | |
| 2,235,191 | A | 3/1941 | Arnould | |
| 2,598,295 | A | 5/1952 | Pelton | |
| 2,602,171 | A | 7/1952 | Good | |
| 2,642,589 | A | 6/1953 | Cobb | |
| 2,710,414 | A * | 6/1955 | Emery | 5/505.1 |
| 2,974,328 | A | 3/1961 | Hebberd | |
| 3,307,042 | A | 2/1967 | Fogleman | |
| 3,317,932 | A | 5/1967 | Gibbons | |
| 3,905,286 | A * | 9/1975 | Le Grady | 99/450 |
| 4,109,567 | A * | 8/1978 | Gage et al. | 99/450 |
| 4,287,622 | A * | 9/1981 | Lane | 5/505.1 |
| 4,570,275 | A | 2/1986 | Merriman | |
| 4,802,252 | A | 2/1989 | Marmor | |
| 4,841,589 | A * | 6/1989 | Moore | 5/505.1 |
| 5,001,795 | A | 3/1991 | Kasten | |
| 5,109,872 | A | 5/1992 | Conn | |
| 6,618,878 | B1 | 9/2003 | McCoy | |
| 6,834,403 | B1 | 12/2004 | Elliott | |
| 7,096,527 | B2 * | 8/2006 | Malik | 5/504.1 |
| 2005/0273931 | A1 | 12/2005 | Edwards | |

* cited by examiner

*Primary Examiner* — Michael Trettel
(74) *Attorney, Agent, or Firm* — Jackson Walker LLP

(57) ABSTRACT

A folding foot protection device for bedded patients. The folding foot protection device has a top member, typicaly rectangular, which will support a pair of folding legs. The folding legs can move between a use position where they are opened up and make an angle of greater than 90° with respect to the top member or a folded position which they lay adjacent to one another adjacent the top member. The folded or closed position makes the device easy to store.

15 Claims, 5 Drawing Sheets

FOLDING FOOT PROTECTION DEVICE FOR A BEDDED PATIENT

This application claims priority to and incorporates herein by reference, U.S. Provisional Application Ser. No. 61/218,664, filed Jun. 19, 2009.

FIELD OF THE INVENTION

Patient protection devices, more specifically, a folding foot protection device or foot guard for a bedded patient, in the nature of a structure for elevating bed covers above a mattress.

BACKGROUND OF THE INVENTION

Bedded patients, especially those with injuries or impairment in the lower legs or feet, are often made uncomfortable due to the weight of the bedded patient's sheets or blankets (bedding or bedcovers).

In Applicants' personal experience, even a slight weight, just such as a single sheet resting on one's feet, may be enough to aggravate pain.

General prior art structures are known which are designed to maintain a bedding above the lower legs or feet of the patient, but such prior art structures have numerous shortcomings.

OBJECTS OF THE INVENTION

It is an object of Applicants' structure to provide for a folding foot protection device or foot guard for use in conjunction with the bedding of a bedded patient, such that the foot protection device is simple to manufacture, simple to use and convenient.

SUMMARY OF THE INVENTION

Applicants' folding foot protection device for a bedded patient is used in conjunction with bedding in such a manner that a top member, typically rectangular, will support a pair of folding legs at or near the removed end thereof, which folding legs are in an open or use position spaced apart sufficiently to provide for the insertion of the patient's lower legs, feet or torso therebetween and for the support of the bedding above the patient's feet.

DETAILED DESCRIPTION OF THE PREFERRED EMBODIMENT

The figures illustrate Applicants' novel folding foot protection device 10 for use with a bedded patient, typically rectangular. As seen from the figures, foot protection device

10 includes a top member 12 engaging and supported by a pair of folding legs 14/18, each leg having a foot 16/20 thereon.

It is seen that Applicants' foot protection device 10 has legs that are foldable, pivoting with respect to the top member 12 in such a manner that they lay generally within the outer perimeter of the top member and substantially parallel and close therewith when in a folded condition. This ability to fold the legs into the plane of the top member allows for easy storage when the device is not in use.

Turning now to the details of the figures, it is seen that top member 12 is generally rectangular and has side members 12*a* and 12*b* and stop members 12*c* and 12*d* defining a perimeter thereto.

Further, top member 12 may be seen to include leg mounting members 12*e* and 12*f*, just inboard of stop members 12*c* and 12*d*, for pivoting legs 14 and 18 thereto in a manner as set forth in more detail below.

The top member 12 may also include one or more cross braces 12*g* (one illustrated, centrally located between stop members 12*c* and 12*d*) and may have one or more longitudinal braces 12*i* and 12*h* (two illustrated). The use of minimal cross bracing and longitudinal bracing achieves a substantially open top member, but one that is sufficiently strong to support the bedding.

Legs 14 and 18 are seen to be comprised of first elongated portions 14*a*/18*a* and second elongated portions 14*b*/18*b*. These elongated portions are rotatably engaged to leg mounting members 12*e* and 12*f* at curved near ends 14*c*/14*d*, 18*c*/18*d*. At these curved near ends, the elongated portions substantially wrap around members 12*e*/12*f*, so they may rotate. Further, the curved near ends have a shoulder portion 14*g*/14*h*, 18*g*/18*h* that are designed to engage stop members 12*e*/12*f*, so as to locate the legs at an angle of slightly greater than 90° with respect to the plane of top member 12, typically in the range of about 100-125°, thereby providing stability in use.

Figure 1:
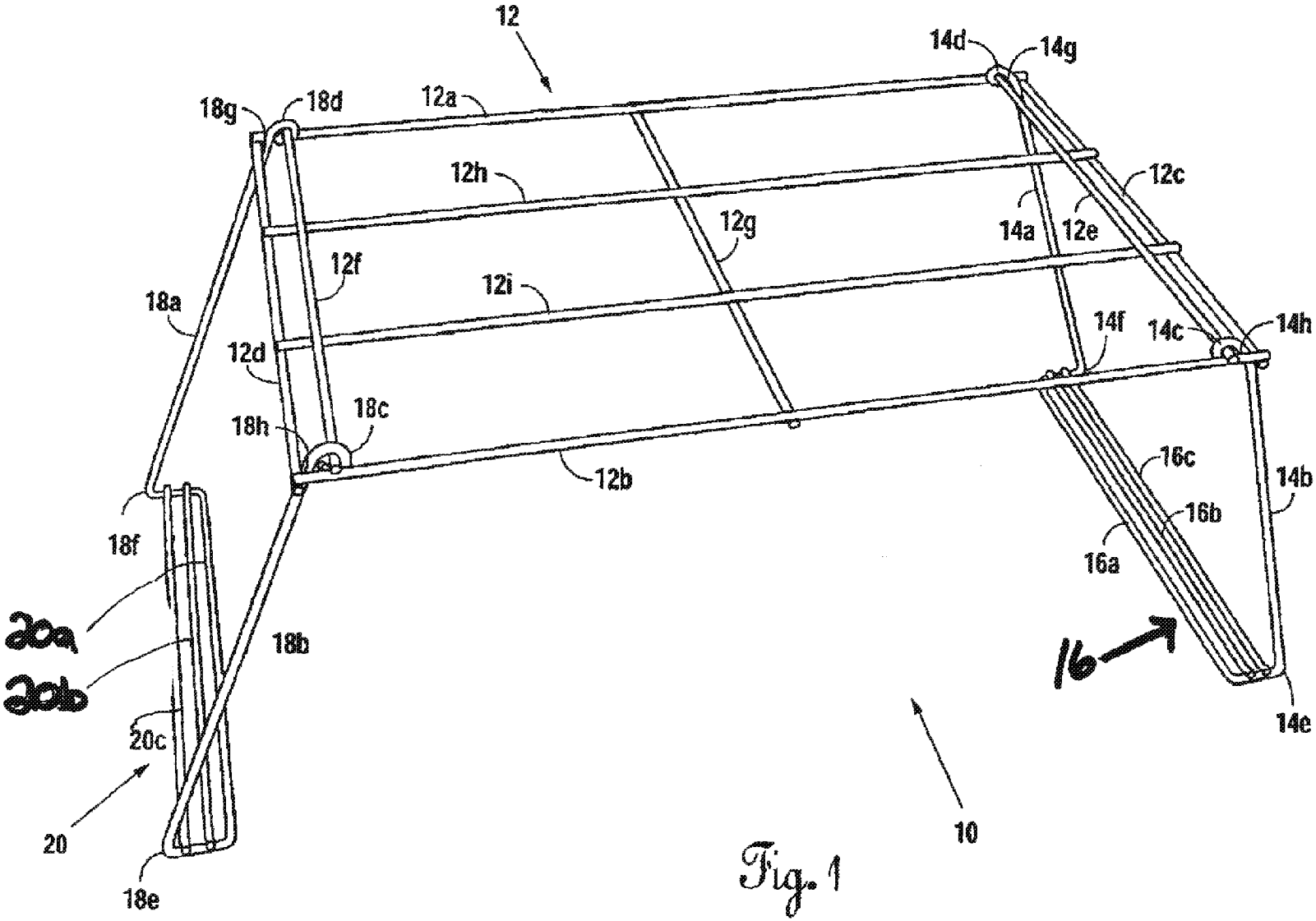
FIG. 1 illustrates a perspective view of Applicants' novel folding foot protection device for a bedded patient in a use position.
Figure 1A:
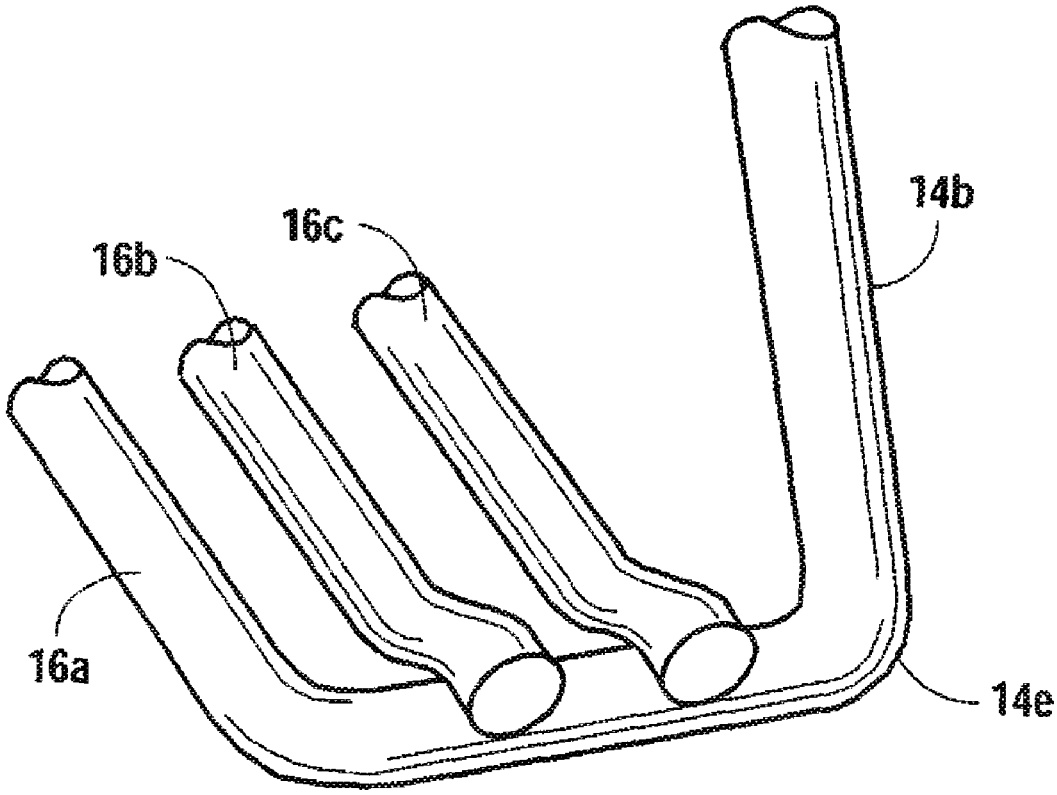
FIG. 1A is a perspective view of the detent or offset curve of the foot section of the legs.
Figure 2:
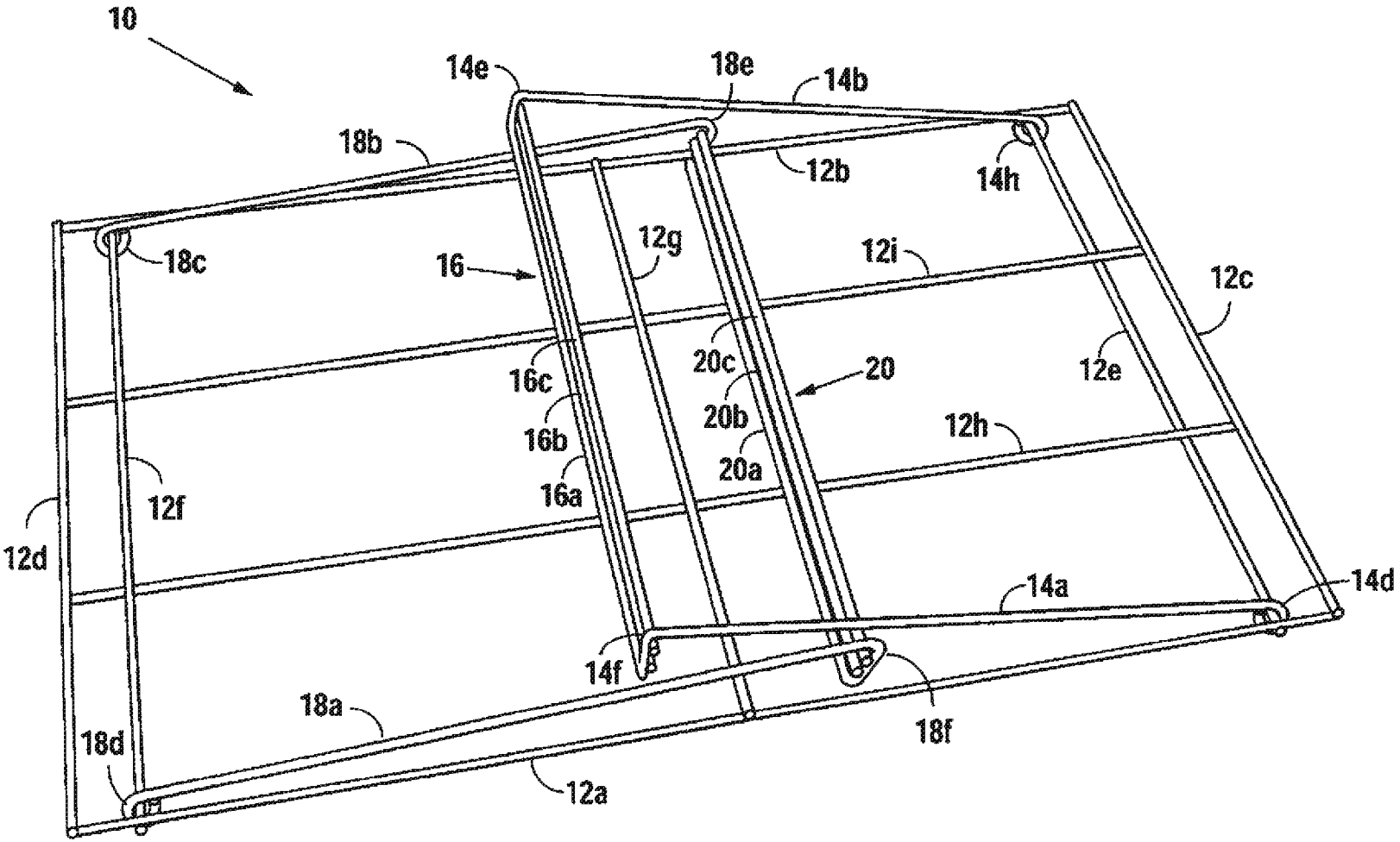
FIG. 2 illustrates a perspective view of the device in a folded or storage position.

Feet 18, 20 are seen to include cross members 16*a*/16*b*/16*c*, 20*a*/20*b*/20*c*. Note that at least some of the cross members may be integral and connect the two elongated portions, here cross members 16*a* and 20*a*. This results from a single wire structurally defining 14*a*/14*b*/14*c*/14*d*/14*e*/14*f*/16*a*, likewise 18*a*/18*b*/18*c*/18*d*/18*e*/18*f*/20*a*. Moreover, feet 18, 20 are typically canted inward so they form an acute angle with respect to the first and second elongated portions and are adapted to lay flat against the top surface of the mattress M (see FIG. 3) and are generally parallel to the plane of top member 12 when foot protection device 10 is in the use or open position as illustrated in FIGS. 1 and 3.

Typical measurements are as follows: 32 inch spread at the outermost part of the legs (use position), and the top member is typically about 24 inches long and 14 inches wide. It is typically held about 1½ inches above the foot portions by the legs when in use. Typically about dimensions as this would cover custom made for obese patients, as well as dimension changes responding to popular demand.

Figure 3:
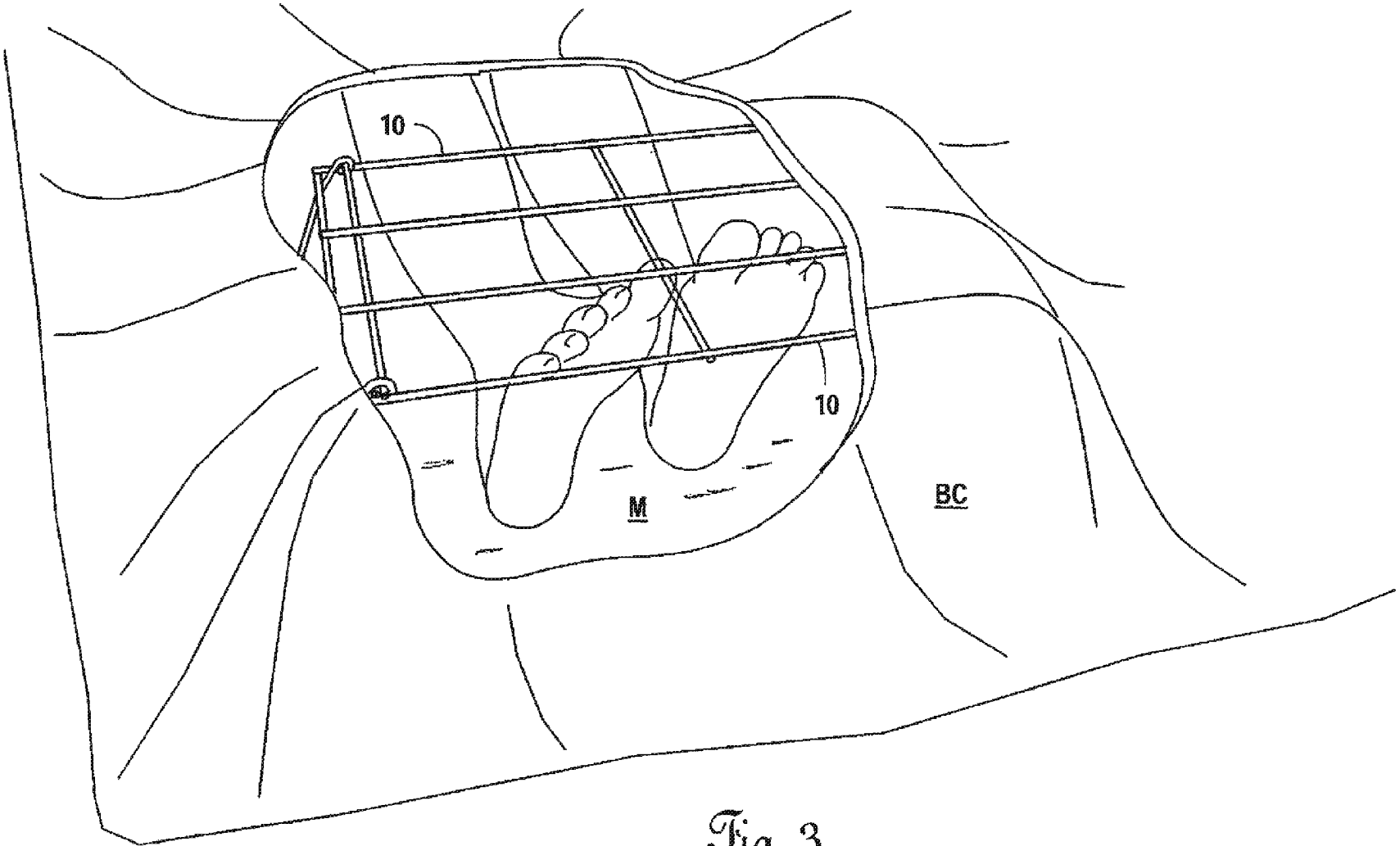
FIG. 3 illustrates a perspective view of the device as used by a patient on a bed in conjunction with bedding.

Use of the foot protection device 10 may be appreciated with reference to FIG. 3. FIG. 3 illustrates the manner in which foot protection device 10 stands upright on the surface of the mattress or sheet-bearing mattress M with bedcovers BC draped over the top member. This provides a tent-like structure allowing sufficient space for movement laterally, vertically, and horizontally of a patient's feet, but without (or minimally) contacting the weight of the bedding, permitting airflow, circulation, and ventilation.

It may further be appreciated with reference to all of the drawings that Applicants' structure is substantially open.

That is to say, the top member is minimally a perimeter member as are both legs, and additional members are kept to a minimum. Materials, such as 5 gauge wire, may be used, tack welded and powder coated, and there are no sharp edges. Stainless steel may be used or chrome plating.

Figure 4:
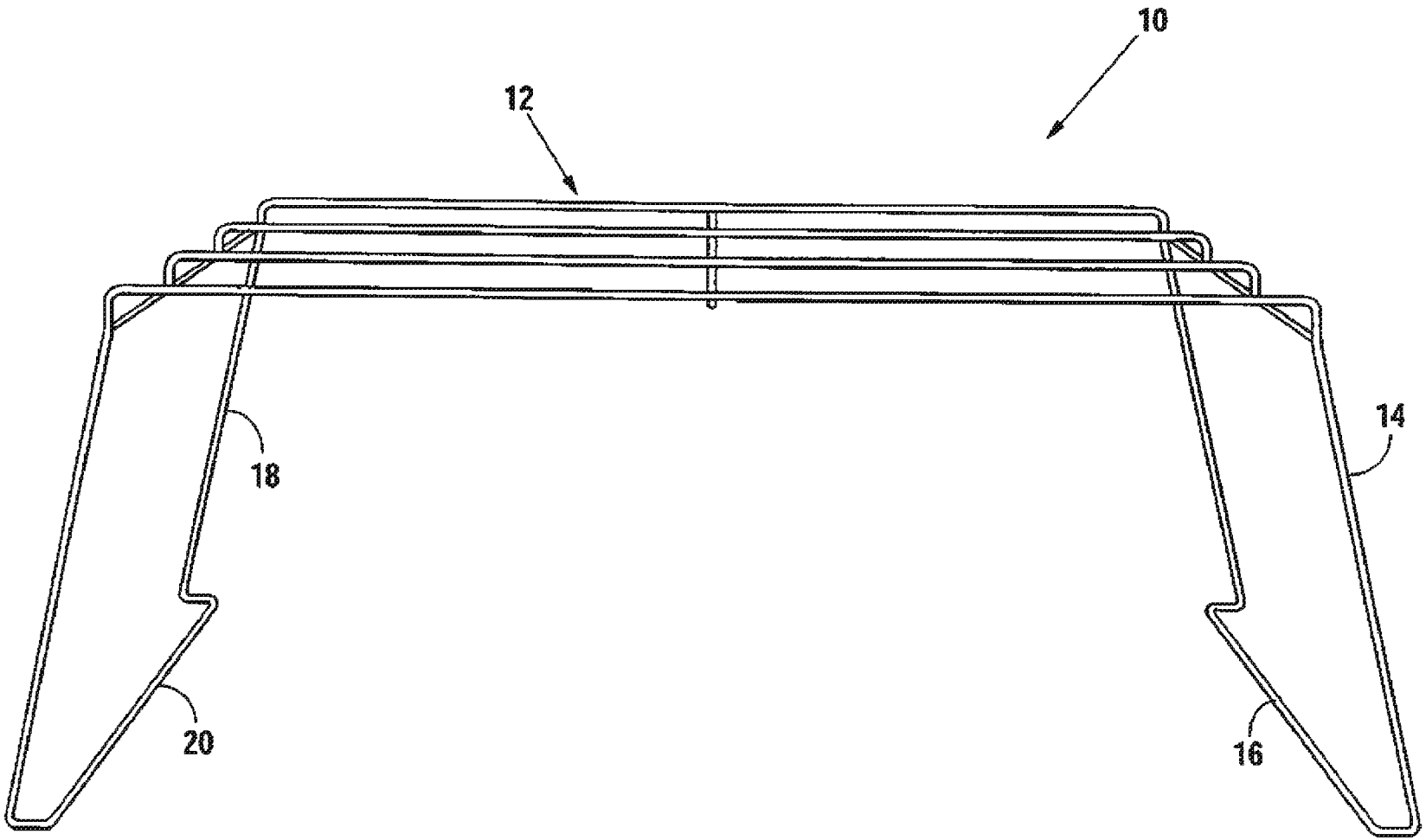
FIG. 4 illustrates an alternate preferred embodiment of Applicants' present invention.

FIG. 4 illustrates an alternate preferred embodiment in which there are no folding legs. That is to say, the legs are incorporated into the two outermost longitudinal members as illustrated. Three cross members are used; one centrally located and the other two where the legs join the two inboard longitudinal members. This embodiment is stackable, one upon the other, for easy storage. Even though it does not use the folding legs, it has been found to be effective. The dimensions are substantially similar to the folding embodiment.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A foot protection device for use in combination with a bed having a mattress with a top surface and bedding, the device comprising:

a fixed, non-foldable top member;

a first leg having a first end and second end;

a second leg having a first end and second end, wherein the use position of the legs places each leg at an angle greater than 90° with respect to the top member wherein the first leg and the second leg are pivotally attached at a first end thereof to the top member and foldable between a use and a storage position, the use position wherein the folding member is capable of holding the bedding spaced apart from a patient lying on the top surface of the mattress, wherein the use position of the legs places each leg at an angle greater than 90° with respect to the top member;

wherein the second end of the first leg and the second end of the second leg have feet engaged therewith; and wherein the storage position allows the legs to remain attached to the top member yet lay against one another and next to the top member.

2. The foot protection device of claim 1, wherein top member, first leg and second leg are made of wire.

3. The foot protection device of claim 2, wherein the wire is powder coated or chrome plated.

4. The foot protection device of claim 2, wherein the wire is made of stainless steel.

5. The foot protection device of claim 1, further including stop members for engaging the top member, wherein the stop members are configured to engage the first and second legs, when the first and second legs are in the use position.

6. The foot protection device of claim 1, wherein the feet, when the legs are in the use position, lay in a plane parallel to the plane of the top member and project inward from the second ends of the two legs.

7. The foot protection device of claim 1, wherein the top member is generally rectangular and comprises an assembly of multiple generally straight wire members.

8. The foot protection device of claim 1, wherein the legs comprise wire members integral with feet engaged therewith.

9. The foot protection device of claim 8, wherein the wire is powder coated.

10. The foot protection device of claim 8, wherein the wire is stainless steel.

11. The foot protection device of claim 8, wherein the wire is chrome plated.

12. The foot protection device of claim 1, wherein the feet, when the legs are in the use position, lay in a plane generally parallel to the plane of the top member and project inward from the second ends of the two legs.

13. A foot protection device for use in combination with a bed having a mattress with a top surface and bedding, the device comprising:

a rigid, one non-foldable piece top member;

a first leg having a first end and second end;

a second leg having a first end and second end, wherein the first leg and the second leg are pivotally attached at a first end thereof to the top member and foldable between a use and a storage position, the use position wherein the folding member is capable of holding the bedding spaced apart from a patient lying on the mattress wherein the storage position allows the legs to lay against one another and next to the top member;

further including stop members for engaging the top member, wherein the stop members are configured to engage the first and second legs, when the first and second legs are in the use position;

wherein the use position of the legs places each leg at an angle greater than 90° with respect to the top member;

wherein the second end of the first leg and the second end of the second leg have feet engaged therewith;

wherein the top member is generally rectangular and comprises an assembly of multiple generally straight wire members; and wherein the legs comprise wire members.

14. A method of protecting the feet of a bedridden patient from bedding, the method comprising the steps of:

providing a folding foot protection device having a non-foldable top member;

a first leg having a first end and second end; and a second leg having a first end and second end, wherein the first leg and the second leg are pivotally attached at a first end thereof to the top member and foldable between a use and a storage position, the use position wherein the folding member is capable of holding bedding spaced apart from a patient lying on a mattress;

wherein the second end of the first leg and the second end of the second leg have feet engaged therewith;

wherein the feet, when the legs are in the use position, lay in a plane parallel to the plane of the top member;

placing the folding foot protection device in the use position so the top member is above the feet of the patient and the legs are on the top surface of a mattress straddle the patient's feet and/or torso; and covering the folding foot protection device so that the bedding substantially drapes over the folding foot protection device.

15. A foot protection device for use in combination with a bed having a mattress with a top surface and bedding, the device comprising:

a top member;

a first leg having a first end and second end;

a second leg having a first end and second end;

wherein the first leg and the second leg are pivotally attached at a first end thereof to the top member and foldable between a use and a storage position, the use position wherein the folding member is capable of holding the bedding spaced apart from a patient lying on the top surface of the mattress;

wherein the second end of the first leg and the second end of the second leg have feet engaged therewith;

wherein the feet, when the legs are in the use position, lay in a plane parallel to the plane of the top member and project inward from the second ends of the two legs; and wherein the use position of the legs places each leg at an angle greater than 90° with respect to the top member.

* * * * *